US005789855A

United States Patent [19]

Forsdyke et al.

[11] Patent Number: 5,789,855

[45] Date of Patent: Aug. 4, 1998

[54] AMALGAM POSITIONING IN AN ELECTRODELESS FLUORESCENT LAMP

[75] Inventors: Graham Malcolm Forsdyke, Leicester, United Kingdom; Joseph Darryl Michael, University Heights, Ohio; Steven John Everest, Essex, United Kingdom; Joseph Christopher Borowiec, Schenectady, N.Y.; Zoltan Toth, Monor, Hungary

[73] Assignee: General Electric Company, Schenectady, N.Y.

[21] Appl. No.: 730,799

[22] Filed: Oct. 17, 1996

[30] Foreign Application Priority Data

Oct. 18, 1995 [GB] United Kingdom ..... 9521373

[51] Int. Cl.[6] ..... H01J 65/04

[52] U.S. Cl. ..... 313/490; 313/493; 313/634; 313/635; 313/565

[58] Field of Search ..... 313/490, 493, 313/492, 607, 634, 565

[56] References Cited

U.S. PATENT DOCUMENTS

| | | | |
|---|---|---|---|
| 4,262,231 | 4/1981 | Anderson et al. . | |
| 4,622,495 | 11/1986 | Smeelen | 313/490 |
| 5,258,689 | 11/1993 | Jansma et al. . | |
| 5,412,280 | 5/1995 | Scott et al. | 313/607 |
| 5,412,288 | 5/1995 | Borowiec et al. | 313/490 |
| 5,629,584 | 5/1997 | Borowiec et al. . | |

FOREIGN PATENT DOCUMENTS

| | | |
|---|---|---|
| 646942 | 4/1995 | European Pat. Off. . |
| 660375 | 6/1995 | European Pat. Off. . |
| 1192999 | 5/1970 | United Kingdom . |
| 1319105 | 6/1973 | United Kingdom . |

*Primary Examiner*—Sandra L. O'Shea
*Assistant Examiner*—Joseph Williams
*Attorney, Agent, or Firm*—Fay, Sharpe, Beall, Fagan, Minnich & Mckee

[57] ABSTRACT

An electrodeless fluorescent reflector lamp has a discharge vessel containing a fill, a solenoid in a reentrant and indium on the inner wall of the vessel acting as a primary amalgam. A secondary amalgam of indium may be provided on the reentrant.

The primary amalgam is preferably under an insulative skirt. The vessel has a light reflective coating on the inner wall under the skirt.

The exhaust tube is tipped off at the proximal end of the reentrant or is omitted, the vessel being tipped off at the distal end of the reentrant.

18 Claims, 3 Drawing Sheets

AMALGAM POSITIONING IN AN ELECTRODELESS FLUORESCENT LAMP

FIELD OF THE INVENTION

The present invention relates to a discharge vessel for an electrodeless lamp and to an electrodeless fluorescent lamp comprising such a vessel.

BACKGROUND OF THE INVENTION

An electrodeless fluorescent reflector lamp is known from e.g., EP-A-0,660,375 (PQ-619). Also electrodeless fluorescent lamps are marketed under the trademark GENURA by General Electric Company. Such lamps comprise a discharge vessel the inner wall of which is coated inter alia with a transparent electrically conductive material, and phosphor. The vessel contains a fill which is energized by an RF magnetic field to induce a discharge therein. The RF field is produced by a solenoid housed in a reentrant portion of the vessel. The solenoid is energized by an RF oscillator in turn energized from the mains via a rectifier. The oscillator and rectifier are in a ballast housing which supports the solenoid and discharge vessel. A skirt extends from the housing over part of the surface of the discharge vessel. A light reflective layer is provided on the internal surface of the vessel under the skirt. An exhaust tube extends from the inner end of the reentrant through the solenoid to a position adjacent the oscillator/rectifier circuitry in the ballast housing of stable temperature in operation. A pellet of e.g., lead/bismuth/tin mercury amalgam is held in the exhaust tube remote from the vessel. The pellet is the sole source of mercury vapor of the fill. The position of the pellet is chosen so that in operation of the lamp the temperature is stable and of the correct level to produce the vapor pressure for optimum light output for the type of amalgam used.

Because the tube extends into the housing, the circuit board or boards of the oscillator and rectifier are arranged around the tube. This reduces the options for arranging and supporting the boards in the ballast housing and/or increases manufacturing costs. Furthermore, providing the pellet of amalgam in the exhaust tube and holding it therein, complicates manufacture of the lamp.

U.S. Pat. No. 4,262,231 discloses an electrodeless fluorescent lamp having a discharge vessel having a solenoid for energizing the fill to produce the discharge. The solenoid is not physically isolated from the discharge. Mercury vapor is provided by a lead/tin/bismuth amalgam placed on an interior surface of the envelope. The amalgam is fixed to the glass wall of the envelope via a layer indium.

In U.S. Pat. No. 4,262,231 the source of mercury vapor is not the indium but the lead/tin/bismuth amalgam.

SUMMARY OF THE INVENTION

According to one aspect of the present invention, there is provided an electrodeless fluorescent reflector lamp including a closed discharge vessel with a reentrant portion, where the vessel contains a fill which when energized sustains a discharge. The inner wall of the vessel is coated with at least a layer of light transmissive electrically conductive material and phosphor. The lamp also includes a solenoid in the reentrant for energizing the fill with an RF magnetic field. The lamp further includes means for applying an RF electrical oscillation to the solenoid to produce the field. The lamp also includes a housing containing the applying means. An electrically insulative skirt extends from the housing and over a portion of the vessel, such that the portion of the inner wall of the vessel under the skirt is also coated with light reflective material. The lamp has indium amalgam on the inner wall of the vessel under the skirt acting as a source of mercury vapor for the fill. The lamp also has an exhaust tube extending from a distal end of the reentrant portion remote from the housing and tipped-off at the proximal end of the reentrant portion.

According to another aspect, there is provided an electrodeless fluorescent reflector lamp including a closed discharge vessel having a reentrant portion, where the vessel contains a fill which when energized sustains a discharge. The inner wall of the vessel is coated with at least a layer of light transmissive electrically conductive material and phosphor. The lamp also includes a solenoid in the reentrant for energizing the fill with an RF magnetic field. The lamp further includes means for applying an RF electrical oscillation to the solenoid to produce the field. The lamp also includes a housing containing the applying means. A skirt extends from the housing and over a portion of the vessel, such that the portion inner wall of the vessel under the skirt is also coated with light reflective material. The lamp also has an indium amalgam on the inner wall of the vessel under the skirt acting as a source of mercury vapor for the fill. The discharge vessel is tipped off at the distal end of the reentrant remote from the housing.

Because the primary source of mercury vapor is in the vessel, the exhaust tube is either no longer needed or it need not extend into the ballast housing giving greater freedom for arranging circuit board(s) within the housing. Also the need to place a pellet of amalgam in the tube and to hold it there is avoided.

BRIEF DESCRIPTION OF THE DRAWINGS

For a better understanding of the present invention, reference will now be made by way of example to the accompanying drawings in which.

DETAILED DESCRIPTION OF THE PREFERRED EMBODIMENTS

Figure 1:
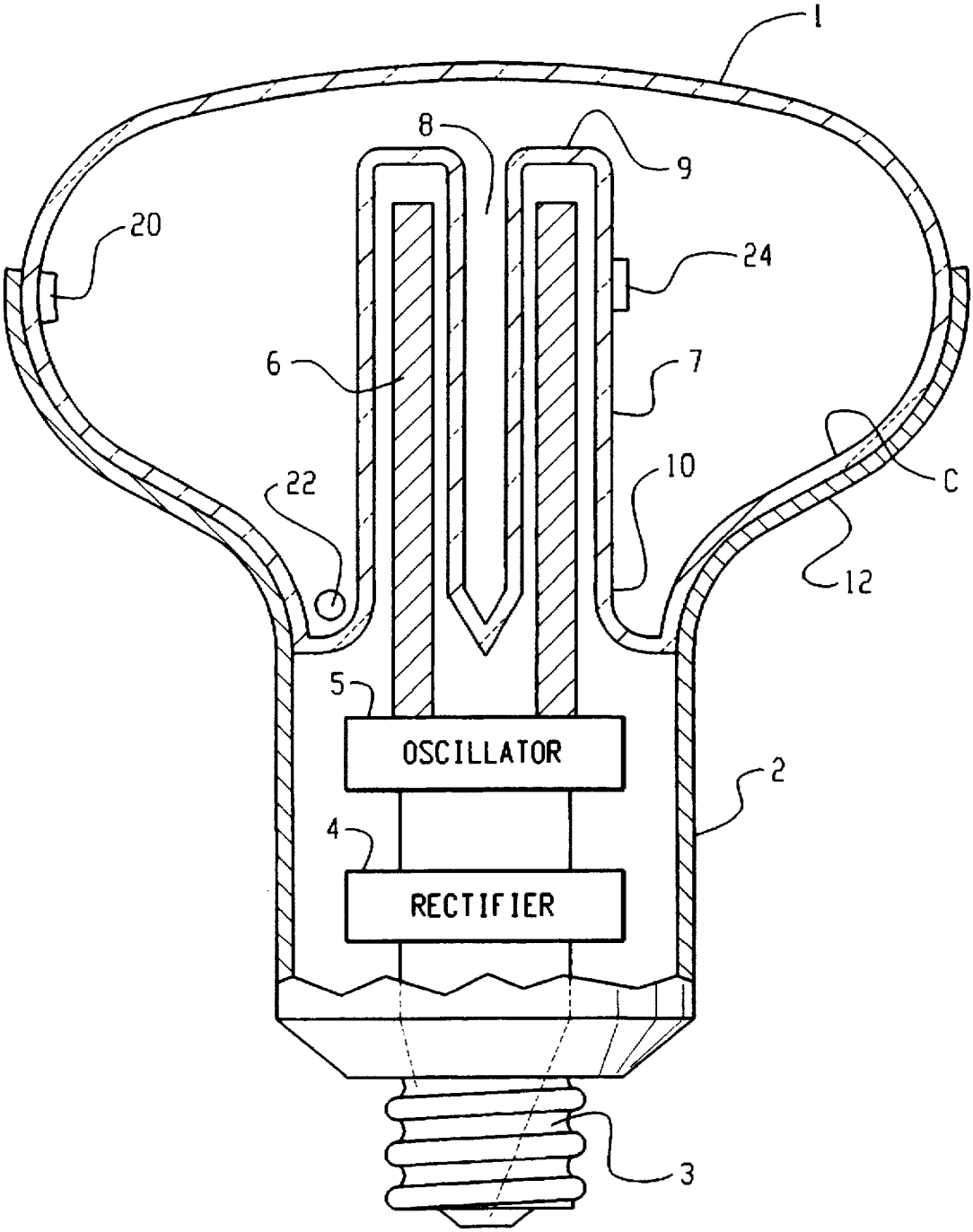
FIG. 1 is a schematic diagram of an illustrate electrodeless fluorescent lamp embodying the present invention.

Referring to FIG. 1 the lamp comprises a discharge vessel 1 of glass supported by an electrically insulative ballast housing 2 to which is connected a lamp cap 3 such as an Edison-Screw cap. The shape of the vessel approximates to that of known incandescent reflector lamps as sold by GE Lighting Limited. An example of such a lamp is an R80 lamp. The housing 2 houses a rectifier 4 and an RF oscillator 5 energized by the rectifier 4. The oscillator 5 energizes a solenoid 6 which is housed in a reentrant portion 7 of the vessel 1. An exhaust tube 8 extends from the distal end 9 of the reentrant 7 innermost of the vessel to the proximal end 10 of the reentrant adjacent the ballast housing 2 where it is tipped-off.

A skirt 12 of opaque insulative material extends from the housing 2 over the discharge vessel to the zone of greatest diameter of the vessel.

The vessel 1 is internally coated with an internal coating C comprising:

(a) a layer of electrically conductive transparent material on the glass wall, to confine the RF field with the vessel;

(b) material on the conductive coating which prevents blackening of the glass by mercury during extended operation of the lamp;

(c) a light reflective layer over the portion of the internal surface under the skirt 12; and (d) phosphor over the reflective layer;

all the materials being known in the art.

The discharge vessel contains a fill as known in the art. The fill is energized by the RF magnetic field to produce a discharge. The primary source of mercury vapor of the fill is a piece of Indium 20 (shown schematically) on the internal surface of the vessel. The Indium 20 forms an amalgam with mercury introduced into the vessel during manufacture thereof. When the lamp is energized, the indium releases the mercury. When the lamp is de-energized, the mercury re-amalgamates with the indium.

The indium is placed on the internal wall at a position at which in stable operation of the lamp, the temperature is appropriate to produce the mercury vapor pressure for optimum light output. That optimum pressure is preferably 0.8 Pa.

The mercury may be introduced during manufacture of the lamp or be already amalgamated with the piece of Indium 20 or by the use of a pellet of zinc 22 amalgamated with mercury. The zinc pellet 22 releases 95% of the mercury once heated to 90° C. The released mercury amalgamates with the Indium 20. The indium is preferable provided on the glass vessel under the internal coating C. Alternatively, the coating C may be omitted from the region occupied by the indium. The Indium 20 may be in the form of a spot or a band.

A secondary source 24 of mercury vapor may, optionally, be provided in the form of a piece of indium on the reentrant to provide quicker "run-up" of the lamp. The secondary source is placed adjacent the discharge to be quickly heated. The secondary source is provided in a zone of the reentrant on the conductive coating but otherwise devoid of coating C or it may be under the coating C.

The indium is preferably provided at the zone of greatest diameter of the glass vessel under the skirt 20 so that it is not visible to a user of the lamp.

Figure 2:
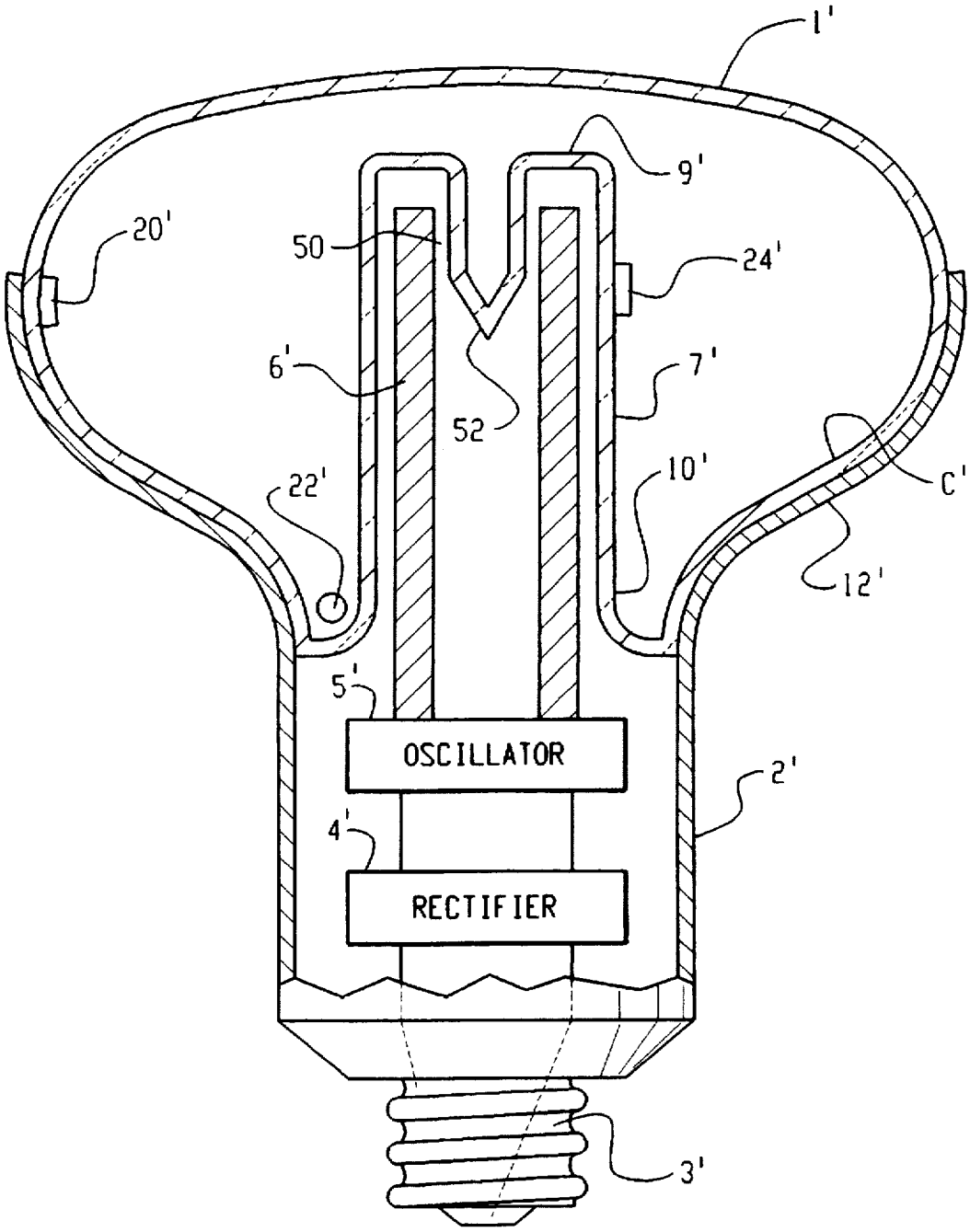
FIG. 2 is a schematic diagram of an electrodeless fluorescent lamp having a short exhaust tube.

FIG. 2 illustrates another embodiment of an exhaust tube. For ease of understanding this embodiment of the present invention, like components are designated by like numerals with a primed (') suffix and new components are designated by new numerals. In this embodiment, the exhaust tube 50 is shorter and does not extend to the proximal end 10' of the reentrant portion 7' adjacent the ballast housing 2'. The end 52 of the exhaust tube 50 is tipped-off. The length of the exhaust tube 50 does not affect operation of the lamp.

Figure 3:
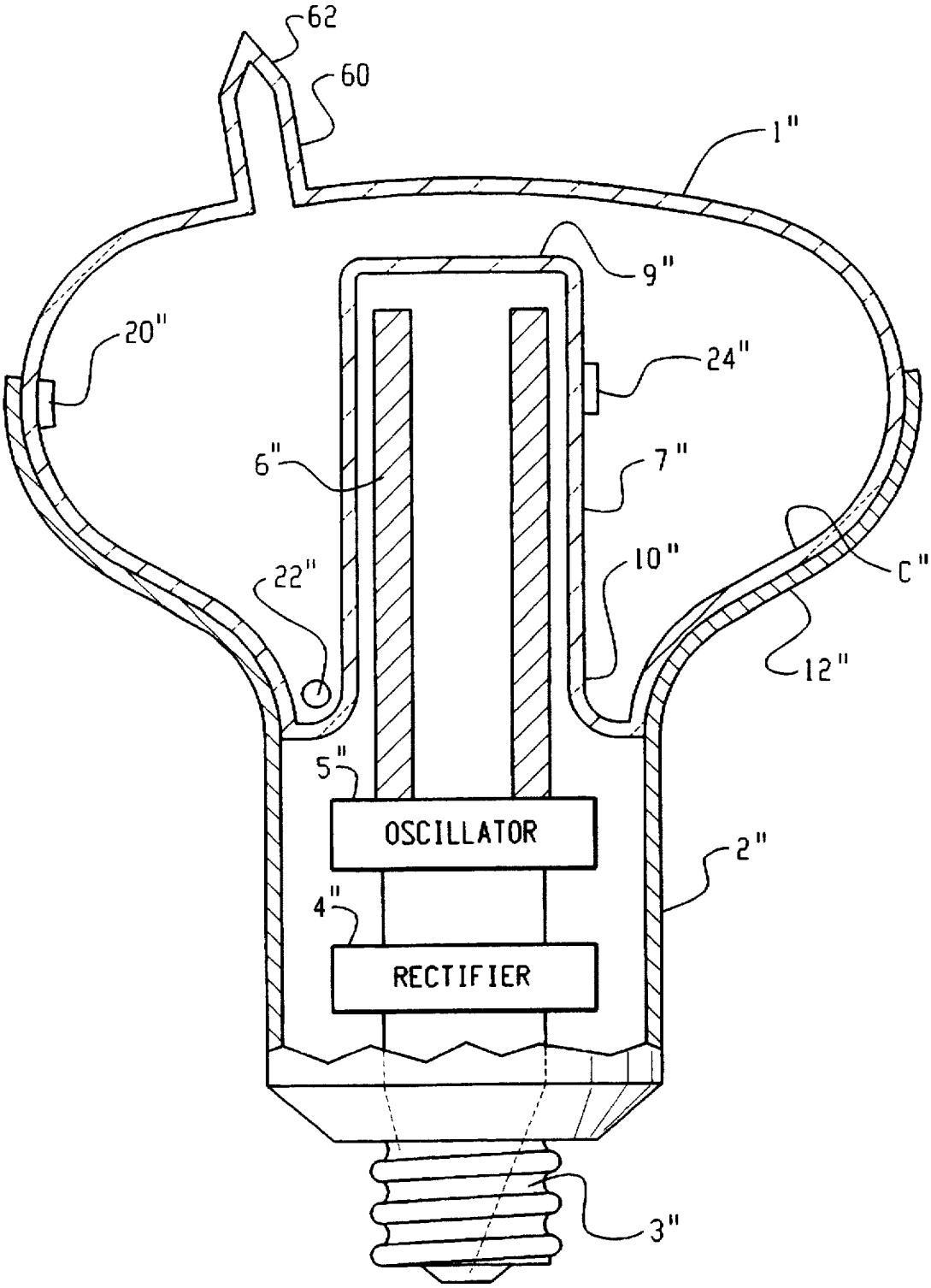
FIG. 3 is a schematic diagram of an electrodeless fluorescent lamp having an exhaust tube extending from the surface of the lamp.

FIG. 3 illustrates another embodiment of an exhaust tube. For ease of understanding this embodiment of the present invention, like components are designated by like numerals with a double-primed (") suffix and new components are designated by new numerals. In this embodiment, the exhaust tube 60 extends outwardly from the surface of the discharge vessel 1" of the lamp. As in the other embodiments, the end 62 of the exhaust tube 60 is tipped-off.

The exhaust tube 8 may be omitted. The vessel 1 is then evacuated of air and provided with the fill via an opening in the end 9 of reentrant which is then sealed.

Because the exhaust tube 8 does not extend into the housing 2, the circuit board(s) of the oscillator and rectifier may be arranged without taking account of the tube 8. Because the source(s) of mercury vapor are in the discharge vessel, no amalgam is needed in the exhaust tube 8.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An electrodeless fluorescent reflector lamp comprising:

a closed discharge vessel having a reentrant portion, the vessel containing a fill which when energized sustains a discharge;

the inner wall of the vessel being coated with at least a layer of light transmissive electrically conductive material and phosphor;

a solenoid in the reentrant for energizing the fill with an RF magnetic field;

means for applying an RF electrical oscillation to the solenoid to produce the RF magnetic field;

a housing containing the applying means;

an electrically insulative skirt extending from the housing and over a portion of the vessel, the portion of the inner wall of the vessel under the skirt being also coated with light reflective material;

indium amalgam on the inner wall of the vessel under the skirt acting as a source of mercury vapor for the fill; and an exhaust tube extending from a distal end of the reentrant portion remote from the housing and tipped-off at the proximal end of the reentrant portion, a position of the exhaust tube not being critical to operation of the lamp.

2. A lamp according to claim 1, wherein there is no amalgam in the exhaust tube.

3. A lamp according to claim 2 wherein the said indium is the primary source of mercury vapor and further comprising indium amalgam on the reentrant portion acting as a secondary source of mercury vapor.

4. A lamp according to claim 1, further comprising a pellet of zinc amalgam within the discharge vessel.

5. A lamp according to claim 2, further comprising a pellet of zinc amalgam within the discharge vessel.

6. A lamp according to claim 3, further comprising a pellet of zinc amalgam within the discharge vessel.

7. An electrodeless fluorescent reflector lamp comprising:

a closed discharge vessel having a reentrant portion, the vessel containing a fill which when energized sustains a discharge;

the inner wall of the vessel being coated with at least a layer of light transmissive electrically conductive material and phosphor;

a solenoid in the reentrant for energizing the fill with an RF magnetic field;

means for applying an RF electrical oscillation to the solenoid to produce the RF magnetic field;

a housing containing the applying means;

a skirt extending from the housing and over a portion of the vessel, the inner wall portion of the vessel under the skirt being also coated with light reflective material;

indium amalgam on the inner wall of the vessel under the skirt acting as a source of mercury vapor for the fill; and the discharge vessel being tipped off at a distal end of the reentrant, the distal end being positioned at any remote location relative to the housing.

8. A lamp according to claim 7 wherein the said indium is the primary source of mercury vapor and further comprising indium amalgam on the reentrant portion acting as a secondary source of mercury vapor.

9. A lamp according to claim 7, further comprising a pellet of zinc amalgam within the discharge vessel.

10. A lamp according to claim 8, further comprising a pellet of zinc amalgam within the discharge vessel.

11. An electrodeless fluorescent lamp comprising a discharge vessel containing a fill, which when energized, produces a discharge in the vessel, and a coating including at least a phosphor for producing light in response to the discharge, the discharge vessel having a reentrant portion housing an RF magnetic field producer in the vessel to energize the fill, a primary source of the mercury vapor of the fill, and an exhaust tube, wherein the primary source comprises indium on the wall of the discharge vessel for forming an indium/mercury amalgam with the mercury vapor of the fill, and wherein a position of the exhaust tube on the vessel is not critical to operation of the lamp.

12. A lamp according to claim 11 wherein the indium is on the wall at a position, which in operation of the lamp is at a temperature which generates a mercury vapor pressure of about 0.8 Pa.

13. A lamp according to claim 11 wherein the vessel further contains a zinc pellet amalgamated with mercury.

14. A lamp according to claim 11 further comprising indium on the reentrant for forming a secondary source of mercury vapor.

15. A lamp according to claim 11 wherein the exhaust tube extends from the end of the reentrant innermost of the discharge tube to an opposite end of the reentrant, the exhaust tube being sealed adjacent the opposite end.

16. A lamp according to claim 11 wherein a length of the exhaust tube is not critical to operation of the lamp.

17. A lamp according to claim 11 wherein the exhaust tube extends outwardly from the vessel.

18. A lamp according to claim 11 wherein the exhaust tube extends from a distal end of the reentrant portion remote from the housing and is tipped-off before a proximal end of the reentrant portion.

* * * * *